United States Patent [19]

Patin

[11] 4,053,044

[45] Oct. 11, 1977

[54] SYSTEM FOR CONTINUOUS ENTRAINMENT AT VARIABLE SPEED

[76] Inventor: Pierre Patin, 9 rue Nicolas Houel, 75005 Paris, France

[21] Appl. No.: 736,230

[22] Filed: Oct. 27, 1976

Related U.S. Application Data

[63] Continuation of Ser. No. 585,519, June 10, 1975, abandoned.

[30] Foreign Application Priority Data

June 14, 1974 France ..... 74.20681

[51] Int. Cl.[2] ..... B61B 13/14

[52] U.S. Cl. ..... 198/334; 104/25; 198/792

[58] Field of Search ..... 104/18, 20, 25, 172 C; 198/334, 792; 59/78.1; 74/255 R; 308/239

[56] References Cited

U.S. PATENT DOCUMENTS

| | | | |
|---|---|---|---|
| 3,565,238 | 2/1971 | Candela | 104/25 X |
| 3,772,875 | 11/1973 | Viano | 59/78.1 |
| 3,834,520 | 9/1974 | Patin | 104/25 X |
| 3,884,152 | 5/1975 | Emeriat | 104/25 |

*Primary Examiner*—Robert J. Spar
*Assistant Examiner*—Randolph A. Reese
*Attorney, Agent, or Firm*—Cameron, Kerkam, Sutton, Stowell & Stowell

[57] ABSTRACT

Principal movable elements are mounted for displacement on a first rolling track and coupled together in pairs by a flexible link of constant length. Auxiliary movable elements are mounted for displacement on a second rolling track. The spacing between the first and second rolling track is variable along at least a part of the path of travel. Each flexible link passes over two deflecting members each mounted integrally on one of the principal movable elements. A central portion of each flexible link is always positioned substantially in the direction of displacement and the two extreme portions of each link are respectively secured to an auxiliary movable element without rigid part between a principal and an auxiliary element.

5 Claims, 5 Drawing Figures

SYSTEM FOR CONTINUOUS ENTRAINMENT AT VARIABLE SPEED

This is a continuation of application Ser. No. 585,519, filed June 10, 1975 now abandoned.

The invention relates to the continuous entrainment at variable speed of elements displaceable along a trajectory.

Devices for entrainment at variable speed are known, comprising rigid articulated elements, the articulations being guided along at least two tracks whereof the spacing varies. These transmit the driving forces very poorly however and the speed variation ratio hardly falls outside 2:1 to 3:1 since, beyond these values, the losses caused by friction and the stresses existing in the rigid elements and the articulations become excessive.

Systems are also known, in which a flexible link connects two consecutive moving cabins. The extremities of the link are fastened, respectively, to each of these cabins, and a pulley-block which slides transversely along a guide integral with a cabin under the action of a variable spacing cam surface or ramp provides the variation in spacing between the cabins and thus in their speed. This device implies the need to have available a guide positioned transversely to the conveying direction; consequently, it is not applicable in practice except to systems comprising for example carried cabins.

The object of the present invention is to allow of great variations in speed without resorting to mechanical arrangements which complicate the system and affect its energy balance.

According to the invention there is provided a system for continuous entrainment at variable speed along a path of travel comprising principal movable elements mounted for displacement on a first rolling track and coupled together in pairs by a flexible link of constant length, auxiliary movable elements mounted for displacement on a second rolling track, the spacing between said first and second rolling tracks being variable along at least a part of the path of travel each said flexible link passing over two deflecting members each one mounted integrally with one said principal movable element, so that a central portion of each flexible link is always positioned substantially in the direction of displacement, and wherein the two extreme portions of each link are respectively secured to an auxiliary movable element without rigid part between a principal and an auxiliary elements.

According to a particular form of embodiment, the first rolling track is substantially parallel to the direction of the travel path. The loads to be carried are then advantageously placed on the principal movable elements and carried thereby.

According to another form of embodiment, the second rolling track is substantially horizontal and the first track is positioned below the second track, at a variable level which drops for the speed of the principal movable elements to diminish and rises for it to increase. The loads to be carried, for example such as cabins, are then advantageously suspended from the principal movable elements.

The continuous entrainment system in accordance with the invention renders it possible to provide a variable-speed handrail. To this end, the principal movable elements form principal supports which are displaced at variable speed along a path and the flexible link is formed by a connection which may bend freely in one direction only and forms a secondary support between two principal supports.

According to a particular form of embodiment, the connection is a chain equipped with adjacent blocks situated at one and the same side with respect to the surface passing through the link joint axes. These blocks advantageously comprise an adjustable stop which renders it possible to keep the sag of the secondary support between two principal supports equal to zero, and this despite the attrition of the chains.

The invention will now be described by way of example with reference to the accompanying drawings wherein:

FIG. 1 diagrammatically illustrates an entraining system whereof the principal movable elements have a substantially rectilinear trajectory;

FIG. 2 diagrammatically illustrates an entraining system whereof the auxiliary movable elements have a substantially rectilinear trajectory;

Figure 1:
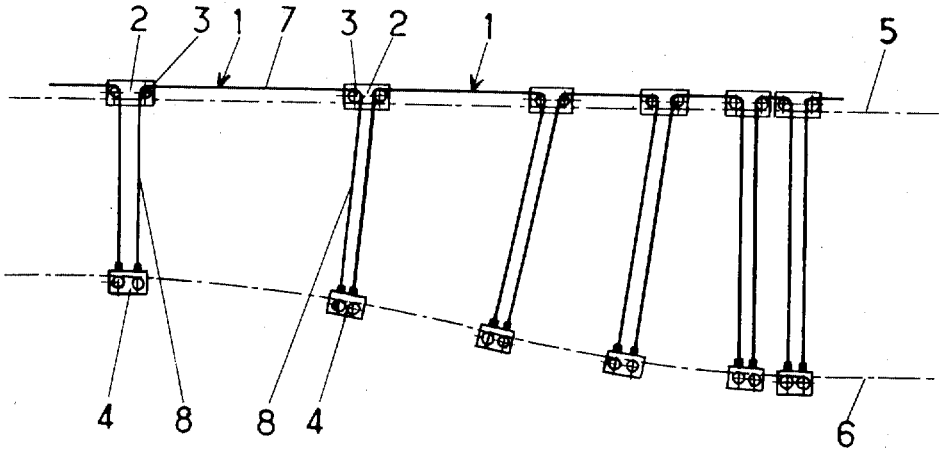

FIG. 1 diagrammatically illustrates a part of a variable speed entrainment system in accordance with the invention. It comprises a set of flexible links 1, principal movable elements 2 each equipped with two deflecting pulleys 3 and auxiliary movable elements 4. The principal movable elements 2 are displaced along a principal rolling track 5 substantially parallel to the direction of travel. The auxiliary movable elements 4 are guided along an auxiliary rolling track 6; this is parallel to the principal rolling track 5 in the areas in which the speed of the principal movable elements is constant, whereas it moves away from or comes closer to the same for them to be slowed down or speeded up. The extremities of each flexible link 1 are fastened to an auxiliary movable element 4, one and the same element 4 receiving one extremity of two adjacent links 1. Each flexible link 1 passes over the two deflecting pulleys 3 moreover.

The complete entrainment system (not illustrated forms a closed loop which may comprise an optional number of constant speed or variable speed areas. At least one propelling device (not illustrated) which provides the displacement of this assembly, acts in at least one constant speed area on the principal movable elements 2. It is of any known type for entraining elements appearing in a continual manner and at substantially even intervals. The force supplied by this propelling device is then transmitted onwards by degrees by the flexible links 1 which are tensioned constantly.

The entraining force is thus transmitted particularly well from one principal movable element 2 to a following one, by the central portion 7 of a link 1 which is always positioned substantially along the direction of travel. Moreover, the tension appearing in the extreme portions 8 is balanced by the reaction of the movable elements 2 and 4 on their rolling tracks 5 and 6, this reaction substantially at right angles to the direction of the displacement, introducing no more than very small interference stresses caused by the rolling resistance of the movable elements on their tracks. The system is thus mechanically very advantageous and power-saving.

Moreover, it will be observed that no rigid linkage of any kind, such as an articulated arm or slideway, is present between the principal and auxiliary movable elements. As a matter of fact, the entrainment of these latter elements occurs due to a small angle of the extreme portions 8 with respect to the line at right angles to the rolling track 6. This angle, corresponding to the coefficient of rolling friction of the elements 4 on their track 6, is very small and not visible on the drawing.

The variation in speed of the principal movable elements 2 is obtained by variation in the spacing between the tracks 5 and 6. In point of fact, the movable elements are entrained at constant speed in at least one area in which the tracks are parallel. When these move apart, the length of the two extreme portions 8 of the links 1 increases at the expense of the length of the central portion 7, that is to say of the distance between two movable elements 2. The result is a reduction in their speed as compared to the constant speed in question. Conversely, when the tracks approach each other, the portions 8 shorten to the benefit of the portion 7, thus producing acceleration.

It will be observed that it is advantageous to select the length of the link 1 such that the aligned movable elements 2 and 4 come into contact in the high-speed areas, so that the tension in the extreme portions 8 is then balanced by the contact force between these elements and no longer by the rolling track reactions, which renders it possible to omit one of them and eliminate the corresponding power losses.

A form of embodiment of this kind of the variable speed entrainment device may be applied to numerous conveying systems. For example, imbricated slabs coupled via one extremity to the principal movable elements 2, the other extremity bearing on the adjacent slab or on the adjacent element 2, may form an accelerated moving walkway. In analogous manner, each principal movable element 2, or a particular number of these may support a cabin for the carriage of persons or goods.

Figure 2:
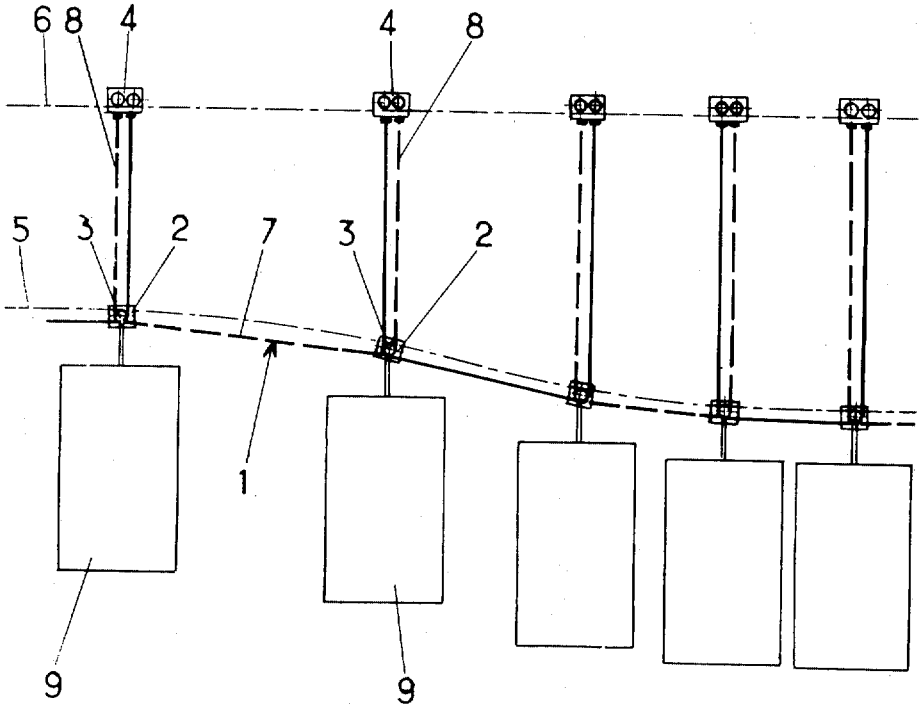

The entrainment device illustrated diagrammatically in FIG. 2 is analogous to that described in the foregoing and illustrated in FIG. 1, in respect of its component elements as well as of its operation. Nevertheless, it differs from the same in the following points: the auxiliary rolling track 6 which receives the auxiliary movable element 4 is substantially rectilinear, whereas the principal rolling track 5 whereon are displaced the principal movable elements 2 moves away from or comes closer to it so that the speed of these latter decreases or increases.

A form of embodiment of this nature is particularly advantageous in the case of a conveying system comprising suspended cabins or the like. These cabins 9 are then hooked on to the principal movable elements 2, or to some of them only if appropriate. The benefit of this configuration is that upon starting off after an intentional or involuntary operational stop, the action of weight on the cabins is advantageous in the deceleration areas which amplify the forces, whereas it is not too disadvantageous in the acceleration areas in which the forces are divided.

Another advantage of this configuration, in the case of a suspended-cabin transporter, is that these are lowered in the low-speed areas in which the boarding and alighting operations occur, as compared to their position in the high-speed areas. This difference in level advantageously plays a part in keeping clear a normal passage height below the cabins in the high-speed areas without requiring raised infra-structures for the stations.

The entrainment system in accordance with the invention may be adapted to conveying the facilities of a plurality of types. Moreover, numerous details of embodiment known to one versed in the art will be applied although they have not been described in the foregoing. In particular, it will be observed that two deflecting pulleys 3 may be installed either on two separate spindles (FIG. 1), or on one and the same spindle (FIG. 2), whether the links be open downwards (FIG. 1) or upwards (FIG. 2.). In the same way, each auxiliary movable element may receive one flexible link only instead of two as illustrated, these elements then being twice as many.

Another application of special interest of the entrainment device in accordance with the invention relates to a variable-speed handrail. As a matter of fact, any walkway travelling at variable speed, requires the application of a handrail equally running at variable speed, the walkway and the handrail obeying the same law of displacement.

Figure 3:
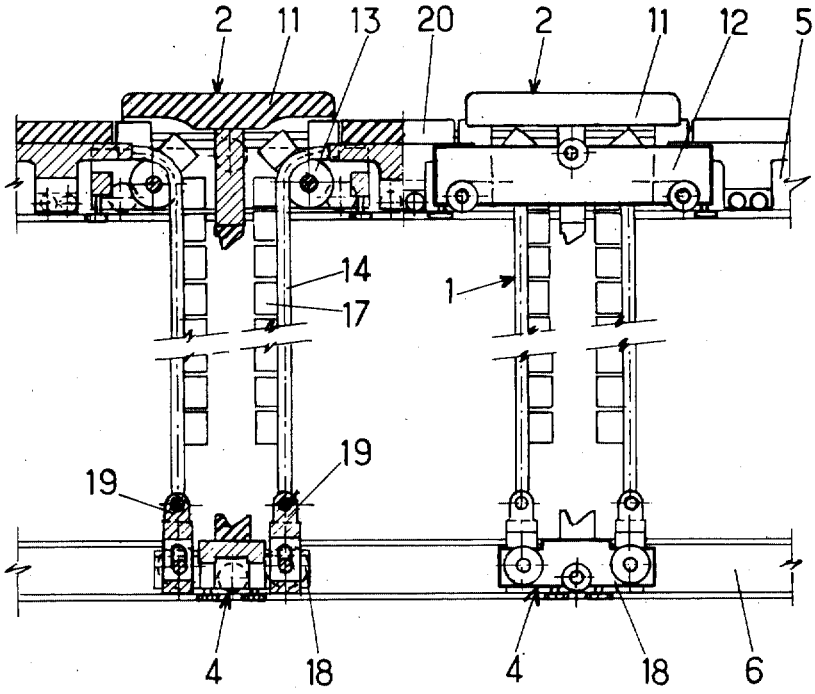
FIGS. 3 and 4 illustrate a portion of a variable-speed handrail, in the "minimum pitch" and "maximum pitch" positions, respectively.
Figure 4:
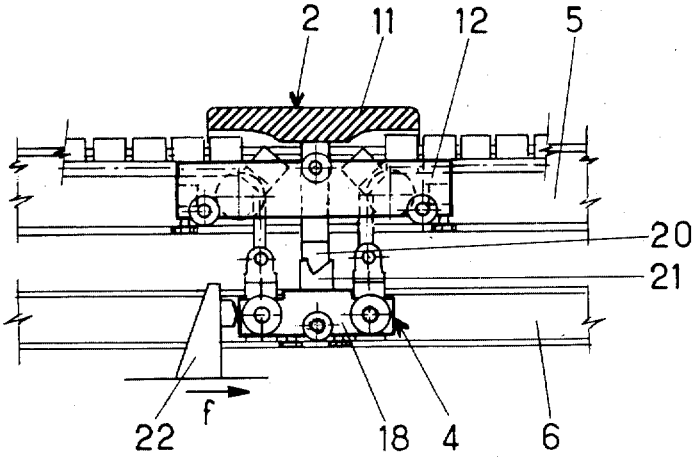

This problem is resolved perfectly by a handrail embodied in accordance with the layout of FIG. 1. To this end, the principal movable elements 2 form safe principal supports on which the passenger may brace himself. It is of importance however to include the possibility of risk-free support at all points. To this end, the flexible link 1 is sufficiently rigid to withstand any downward flexing between the elements 2 carrying it, whereas it may bend freely in the other direction to wind around deflecting members 3. FIGS. 3 and 4 partially illustrate a handrail of this nature.

FIG. 3 illustrates two elements in the "minimum pitch" position, that is to say brought as close to each other as possible, which corresponds to a low-speed area.

FIG. 4 illustrates an element in the "maximum pitch" position, that is to say that the central portion 7 of the link 1 has its greatest length, which corresponds to a high-speed area. The principal movable element 2 is in contact with the auxiliary movable element 4.

Each principal support comprises a carriage 12 guided in the upper track 5 and a covering 11 whereof the shape resembling a handle to be grasped by a passenger. The flexible link 1 is formed by a chain 14 whereof one surface is equipped with adjacent blocks 17. Thus, the link is free to bend towards the side opposite to that of the adjacent blocks 17, whereas any flexing towards the side of the latter is impossible. Each auxiliary movable element 4 comprises a tensioning carriage 18 totally guided along the lower track 6 and two chain shackles 19 on each of which is secured one extremity of the chains 14 of each of the two adjacent links 1.

At its middle, the flexible link 1 advantageously comprises an intermediate carriage 20 which runs on the upper track 5 and reduces the span of the central portion of the link 1 in order to limit the sag, in particular in the "maximum pitch" configuration in which the distance between two principal supports 2 is a maximum.

In the high-speed (FIG. 4), the principal and tensioning carriages 12 and 18 come into contact via a part of their lower and upper bases, respectively. The tension in the extreme chain portions is thus balanced by the contact force between these carriages and no longer by the reaction of the lower track 6 on the tensioning carriage 18, which track may then be omitted.

Moreover, the parts 20 and 21 in contact have a form which renders apparent a support face substantially at right angles to the direction "f" of displacement. This renders it possible to apply the propulsive force serving the purpose of general entrainment of the system, by means of an propelling device 22 of the cogged chain type, which acts on the tensioning carriage 18 which transmits this force to the principal carriage 12 via this support face.

Figure 5:
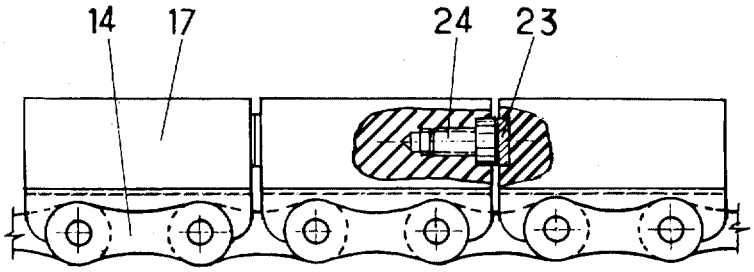
FIG. 5 illustrates a chain having a single bending direction, equipped with adjustable stops.

A detail of the embodiment of the link having a single bending direction is illustrated in FIG. 5. Each link of the chain 14 is topped by a block 17. These blocks 17 are contiguous when the chain is rectilinear, which eliminates any possibility of bending towards their side. In practice, it is impossible to produce fully contiguous blocks in view of the attrition of the chain links and of the blocks 17 in particular. To eliminate this shortcoming, the opposed surfaces of two adjacent blocks 17 are equipped, respectively, with a small bearing plate 23 and with a stop screw 24. The small bearing plate 23 may be sufficiently tough for its wear to be very small, it may be replaceable moreover. The stop screw 24 comprises an arrestor device (not illustrated) which prevents any loss of adjustment during operation; by action on the same, by unscrewing, it is possible to keep the sag of the chain between the two principal supports 2 equal to nought, which adjustment may be performed periodically.

Numerous details of embodiment known to one versed in the art may obviously be applied although not described in the foregoing. Analogously, any device may be replaced by equivalent devices without exceeding the scope of the present invention.

What I claim is:

1. A system for continuous entrainment at variable speed along a path of travel, comprising principal movable elements mounted for displacement on a first rolling track and coupled together in pairs by a flexible link of constant length, auxiliary movable elements mounted for displacement on a second rolling track, the spacing between said first and second rolling tracks being variable along at least a part of the path of travel, each said flexible link passing over two deflecting members each one mounted integrally with one of said principal movable elements so that a central portion of each flexible link is always positioned substantially in the direction of displacement, and wherein the two extreme portions of each link are respectively secured to two separate auxiliary movable elements without rigid part between a principal and an auxiliary elements.

2. A system according to claim 1, wherein said first rolling track is substantially parallel to the direction of said travel.

3. A system according to claim 2, wherein said principal movable elements form principal supports which are displaced at variable speed along a path, said flexible link being formed by a connection which may bend freely in one direction only and forms a secondary support between two principal supports.

4. A system according to claim 3, wherein said connection is a chain equipped with contiguous blocks situated at one and the same side with respect to a surface passing through the link hinge axes.

5. A system according to claim 1, wherein said second rolling track is substantially horizontal and said first track is positioned below the second track at a variable level which is lowered to diminish the speed of the principal movable elements and raised to increase said speed.

* * * * *